US005706831A

United States Patent [19]

Whitbeck

[11] Patent Number: 5,706,831

[45] Date of Patent: Jan. 13, 1998

[54] BALL MARK REPAIR TOOL WITH CIGAR SUPPORTING ACCESSORY

[76] Inventor: Norman F. Whitbeck, 2400 Feather Sound Dr. #125, Clearwater, Fla. 34622

[21] Appl. No.: 708,925

[22] Filed: Sep. 6, 1996

[51] Int. Cl.[6] ..... A24F 13/02

[52] U.S. Cl. ..... 131/187; 273/32 A

[58] Field of Search ..... 473/286, 408; 273/32 B, 32 A; 131/187, 190, 329, 178, 248, 240.1, 241; 81/427.5; 7/128, 106, 118

[56] References Cited

U.S. PATENT DOCUMENTS

| | | | |
|---|---|---|---|
| 2,749,919 | 6/1956 | Elswick | 273/32 A |
| 4,627,621 | 12/1986 | Tate | 273/32 A |
| 4,960,239 | 10/1990 | Wait | 273/32 B |
| 5,393,052 | 2/1995 | Kennedy | 273/32 B |

*Primary Examiner*—Vincent Millin
*Assistant Examiner*—Charles W. Anderson

[57] ABSTRACT

A golf tool including a ball mark repair tool for repairing ball marks in turf. Further provided is a cigar support coupled to the ball mark repair tool for supporting a cigar such that neither end of the cigar is in contact with the turf.

14 Claims, 6 Drawing Sheets

FIG 7
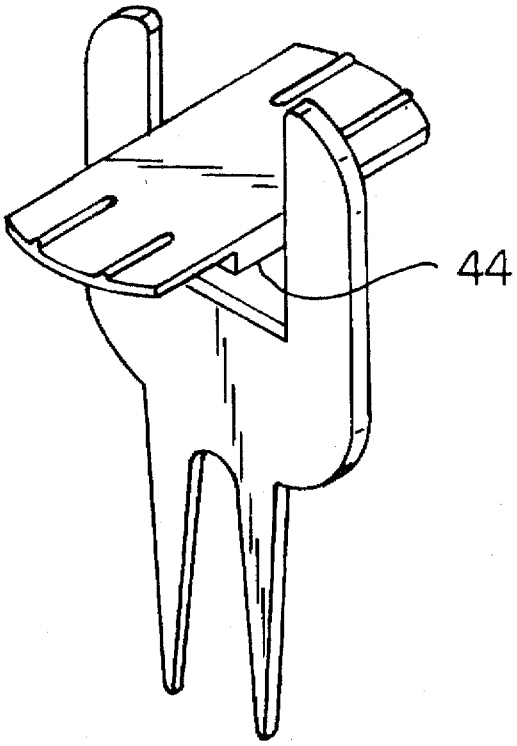
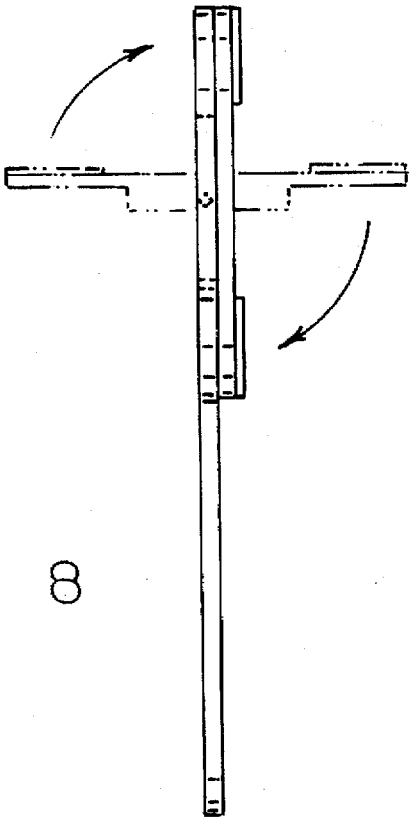
FIG 8

FIG 9A
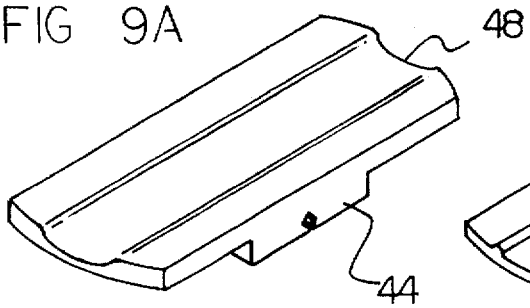
FIG 9
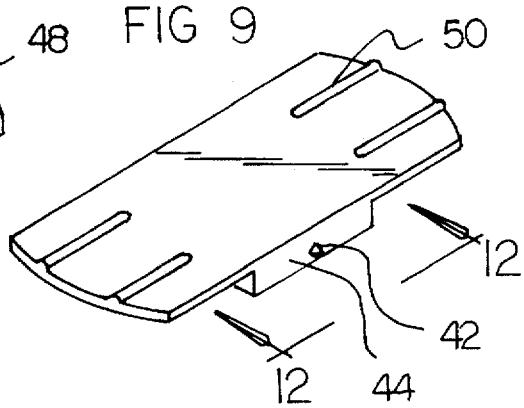
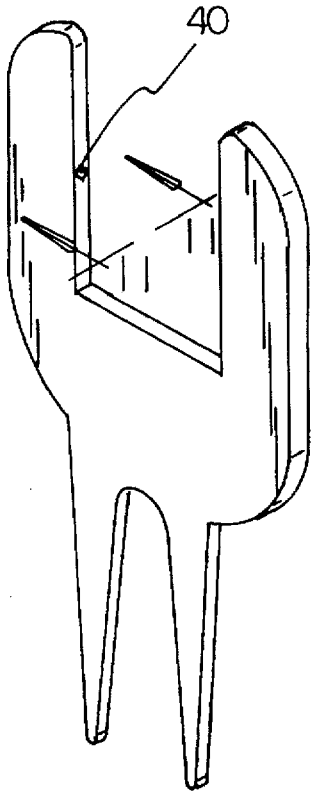
FIG 10
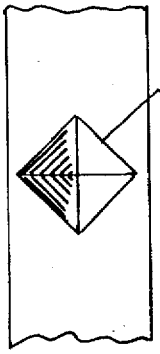
FIG 11
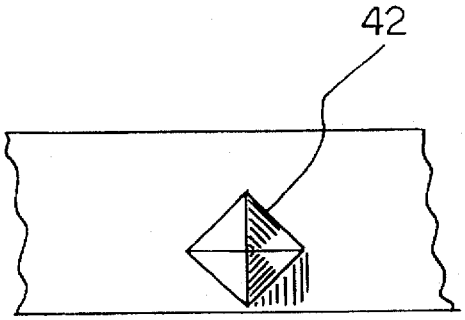
FIG 12

BALL MARK REPAIR TOOL WITH CIGAR SUPPORTING ACCESSORY

BACKGROUND OF THE INVENTION

1. Field of the Invention

The present invention relates to a ball mark repair tool with cigar supporting accessory and more particularly pertains to allowing a user to both support a cigar or cigarette and repair ball marks with a single tool.

2. Description of the Prior Art

In the past, it was common for golfers to lay their cigar or cigarette on the turf of a golf course while playing. Due to problems associated with wet grass extinguishing the cigar or cigarette and further damaging the same, devices were constructed for supporting the lit end of the cigar or cigarette above the ground. Now, with advent of the widespread use of pesticides and fertilizers, such devices pose the problem of exposing the butt of the cigar or cigarette to the ground thereby subjecting the player to these dangerous chemicals.

In addition, it has become popular for many golf tools to have the structure necessary for accomplishing a plurality of tasks. One of such tasks is to repair ball marks with a two-pronged device. Such tools consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 5,292,120 to Pehoski et al. a golf tool for golf equipment which combines various functions and features such as an oval ring for cleaning golf shoe cleats, a golf cleat tightener, a ball mark repair device, and a golf club shaft rest in a single unit.

U.S. Pat. No. 5,143,371 to Strahan discloses a golf aid with a ball mark repair tool, a means of allowing the attachment of a golfing glove, and the unique structure for propping a grip of a golf club above the ground.

U.S. Pat. No. 4,273,329 to Trigg et al. discloses a flag pin attachment including a ball distance measuring line and turf repair tool.

U.S. Pat. No. 4,063,731 to Kitay discloses a golf tool with a distance estimating facility which in turn provides automatic selection of a golf club, a ball mark repair tool, and a cigar holder.

U.S. Pat. No. 3,763,515 to Voss and U.S. Pat. No. 3,185,483 to Klyman are provided as being of general interest.

In this respect, the ball mark repair tool with cigar supporting accessory according to the present invention substantially departs from the conventional concepts and designs of the prior art, and in so doing provides an apparatus primarily developed for the purpose of allowing a user to both support a cigar or cigarette and repair ball marks with a single tool.

Therefore, it can be appreciated that there exists a continuing need for a new and improved ball mark repair tool with cigar supporting accessory which can be used for allowing a user to both support a cigar or cigarette and repair ball marks with a single tool. In this regard, the present invention substantially fulfills this need.

SUMMARY OF THE INVENTION

In view of the foregoing disadvantages inherent in the known types of combination golf tools now present in the prior art, the present invention provides an improved ball mark repair tool with cigar supporting accessory. As such, the general purpose of the present invention, which will be described subsequently in greater detail, is to provide a new and improved ball mark repair tool with cigar supporting accessory which has all the advantages of the prior art and none of the disadvantages.

To attain this, the present invention essentially comprises a ball mark repair mechanism. The ball mark repair mechanism includes a forked extent formed of a pair of downwardly extending elongated arms. Each of the arms has a top end, a bottom end, and a pair of side edges which taper from the top end to the bottom end. As shown in FIGS. 1–3, the ball mark repair mechanism includes an intermediate extent residing within a plane in which the lower extent resides. The intermediate extent has a planar bottom edge integrally formed with the arms and further a top edge. A pair of side edges are beveled upwardly and outwardly between the bottom edge and top edge. The ball mark repair mechanism further includes a top extent in coplanar relationship with the intermediate extent. The top extent has a bottom edge integrally formed with the top edge of the intermediate extent and a pair of vertically extending side edges. A top edge of the top extent has a generally rectangular cut out formed therein. For reasons that will become apparent later, a pair of apertures are formed in the top extent adjacent opposite lower corners of the cut out. As can be seen in FIGS. 5–6, a cigar support is included having a generally rectangular configuration and a V-shaped cross-section. The cigar support is pivotally coupled at an end thereof to the apertures of the top extent. By this structure, the present invention is capable of pivoting between a first orientation and a second orientation. The first orientation is defined by the cigar support residing in a horizontal orientation on one side of the top extent for allowing a cigar to be supported thereon. The second orientation is constituted by the cigar support residing in a vertical orientation in abutment with a second side of the top extent.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved ball mark repair tool with cigar supporting accessory which has all the advantages of the prior art combination golf tools and none of the disadvantages.

It is another object of the present invention to provide a new and improved ball mark repair tool with cigar supporting accessory which may be easily and efficiently manufactured and marketed.

It is a further object of the present invention to provide a new and improved ball mark repair tool with cigar supporting accessory which is of a durable and reliable construction.

An even further object of the present invention is to provide a new and improved ball mark repair tool with cigar supporting accessory which is susceptible of a low cost of manufacture with regard to both materials and labor, and which accordingly is then susceptible of low prices of sale to the consuming public, thereby making such ball mark repair tool with cigar supporting accessory economically available to the buying public.

Still yet another object of the present invention is to provide a new and improved ball mark repair tool with cigar supporting accessory which provides in the apparatuses and methods of the prior art some of the advantages thereof, while simultaneously overcoming some of the disadvantages normally associated therewith.

Still another object of the present invention is to allow a user to both support a cigar or cigarette and repair ball marks with a single tool.

Lastly, it is an object of the present invention to provide a new and improved golf tool including a ball mark repair means for repairing ball marks in turf. Further provided is a cigar support coupled to the ball mark repair means for supporting a cigar such that neither end of the cigar is in contact with the turf.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a perspective view of an alternate embodiment of the present invention.

FIG. 8 is a side elevational view of an alternate embodiment of the present invention.

FIG. 9 is a first form of the cigar support of the alternate embodiment.

FIG. 9A is a second form of the cigar support of the alternate embodiment.

FIG. 10 is a perspective view of the present alternate embodiment.

FIG. 11 is a close up view of the indent of the present alternate embodiment.

FIG. 12 is a close up view of the detent of the present alternate embodiment.

Similar reference characters refer to similar parts throughout the several views of the drawings.

DESCRIPTION OF THE PREFERRED EMBODIMENT

Figure 1:
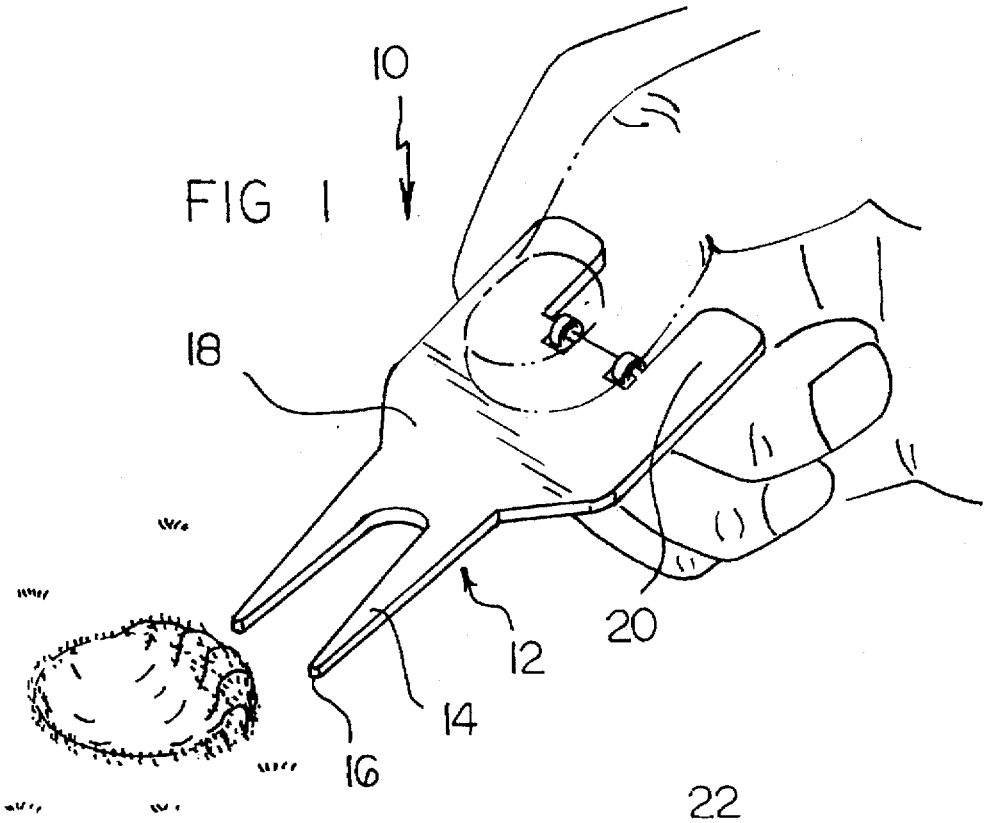
FIG. 1 is a perspective illustration of the preferred embodiment of the ball mark repair tool with cigar supporting accessory constructed in accordance with the principles of the present invention.

With reference now to the drawings, and in particular to FIG. 1 thereof, a new and improved ball mark repair tool with cigar supporting accessory embodying the principles and concepts of the present invention and generally designated by the reference numeral 10 will be described.

The present invention, the new and improved ball mark repair tool with cigar supporting accessory, is comprised of a plurality of components. Such components in their broadest context include a ball mark repair mechanism and a cigar support mechanism. Such components are individually configured and correlated with respect to each other so as to attain the desired objective.

More specifically, it will be noted that the system 10 of the present invention includes a ball mark repair mechanism 12 composed of a metal or plastic. Ideally, the present invention is constructed from brass with a thickness of approximately ⅛ of an inch. The ball mark repair mechanism includes a forked extent 14 formed of a pair of downwardly extending elongated arms 16. Ideally, the arms have a height of approximately 1½ inches. Each of the arms has a top end, a bottom end, and a pair of side edges which taper from the top end to the bottom end.

Figure 2:
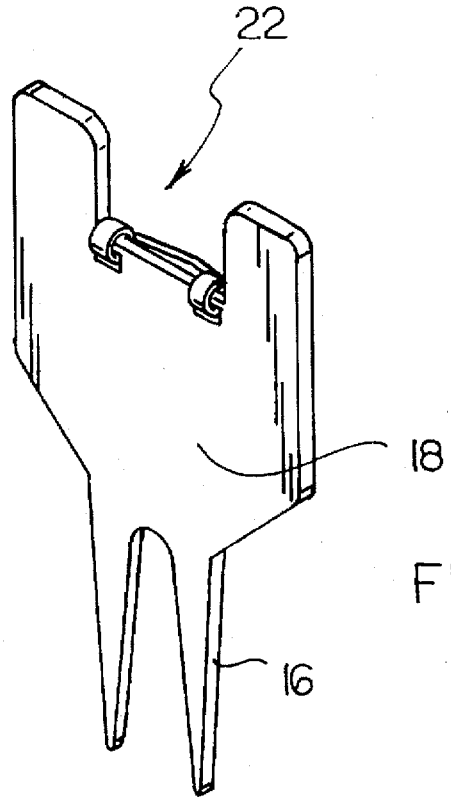
FIG. 2 is a rear perspective view of the present invention.
Figure 3:
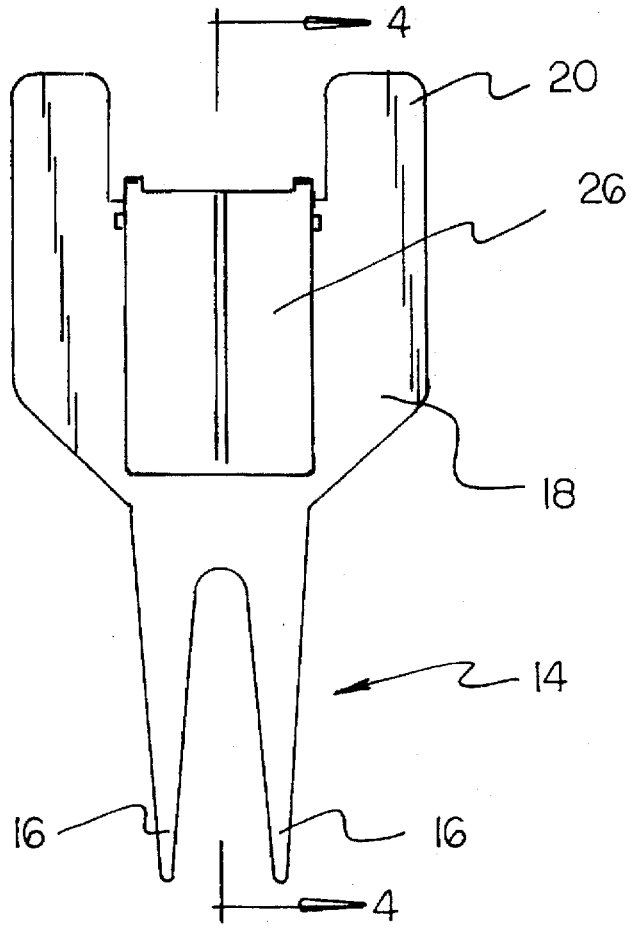
FIG. 3 is an elevational view of the present invention.
Figure 4:
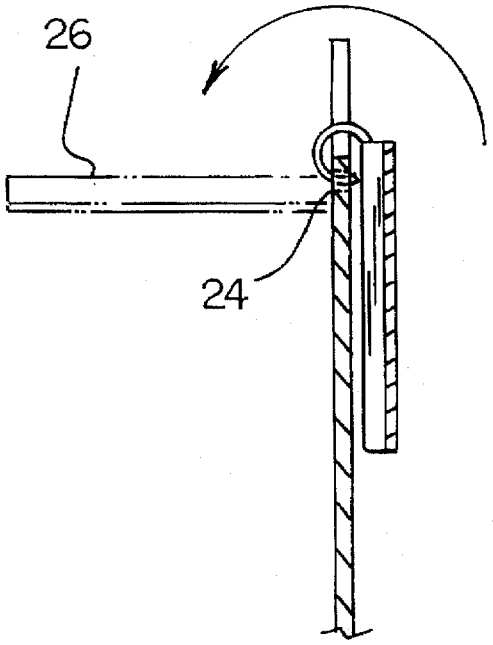
FIG. 4 is a cross-sectional view taken along the line depicted in FIG. 3.

As shown in FIGS. 1–3, the ball mark repair mechanism includes an intermediate extent 18 residing within a plane in which the lower extent resides. The intermediate extent has a planar bottom edge integrally formed with the arms and further a top edge. A pair of side edges are beveled upwardly and outwardly between the bottom edge and top edge. Preferably, the intermediate extent has a height of approximately ½ inch.

The ball mark repair mechanism further includes a top extent 20 in coplanar relationship with the intermediate extent. The top extent has a bottom edge integrally formed with the top edge of the intermediate extent and a pair of vertically extending side edges. A top edge of the top extent has a generally rectangular cut out 22 formed therein. The top extent ideally has a height of 1½ inches and a width of 1¾ inches. For reasons that will become apparent later, a pair of apertures 24 are formed in the top extent adjacent opposite lower corners of the cut out. Such cut out is suitably ½ an inch in depth and ⅞ an inch in width.

Figure 5:
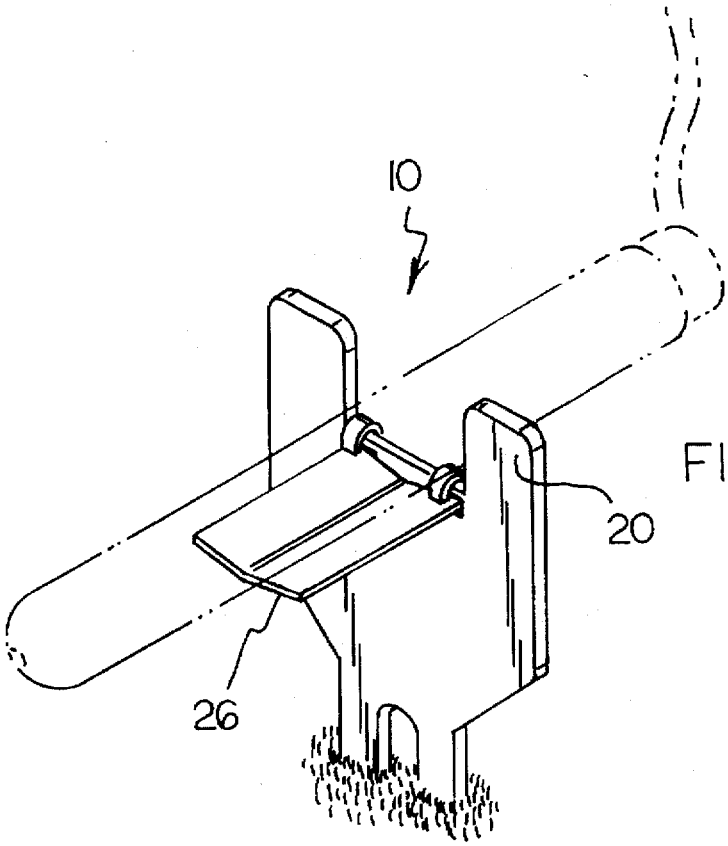
FIG. 5 is a perspective view of the present invention being utilized as a support for a cigar.
Figure 6:
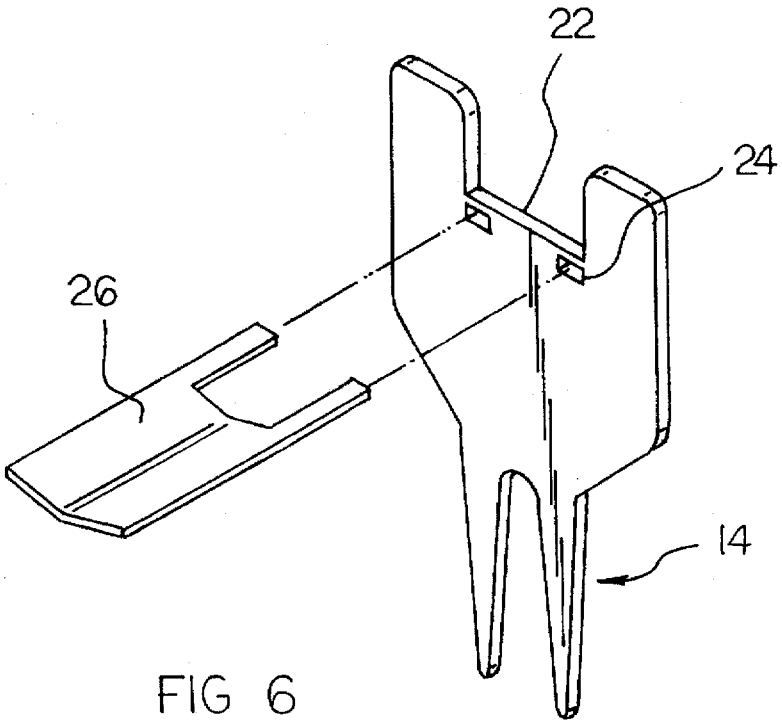
FIG. 6 is an exploded view of the present invention.

As can be seen in FIGS. 5–6, a cigar support mechanism 26 is included having a generally rectangular configuration and a V-shaped cross-section. Preferably, the support has a length of approximately 1¼ inches. As such, the support has a length of approximately 35% the height of the ball mark repair mechanism. The cigar support is pivotally coupled at an end thereof to the apertures of the top extent. To afford such pivotal coupling, the cigar support has a pair of strips extending from opposite ends thereof. Such strips may be inserted within a respective aperture and subsequently bent to form a loop about the bottom edge of the cut out.

By this structure, the present invention is capable of pivoting between a first orientation and a second orientation. The first orientation is defined by the cigar support residing in a horizontal orientation on one side of the top extent for allowing a cigar to be supported thereon. It should be noted that side edges defined by the cut out work in conjunction with the V-shaped cross-section of the cigar support to preclude lateral movement of the cigar. To ensure that the support does not collapse when in a horizontal orientation, the V-shaped cross-section acts to abut the top extent of the ball mark repair mechanism. The second orientation is constituted by the cigar support residing in a vertical orientation in abutment with a second side of the top extent. Ideally, every interconnection of the of edges of the present invention are rounded.

In use, the arms may be used as a ball mark repair device and further be vertically planted in the earth for supporting a cigar, thereby precluding either end of the cigar from contacting the turf.

Figure 13:
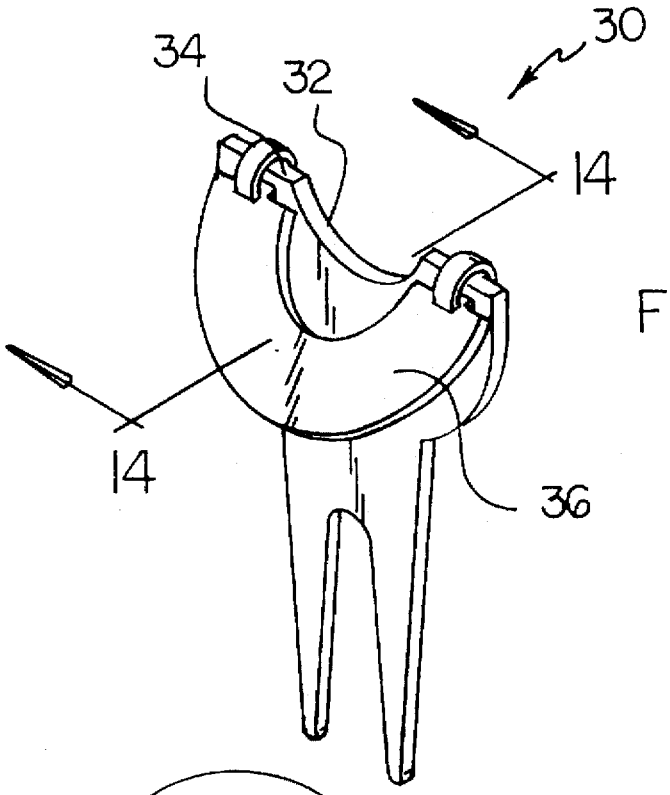
FIG. 13 is a perspective view of yet another alternate embodiment of the present invention.
Figure 14:
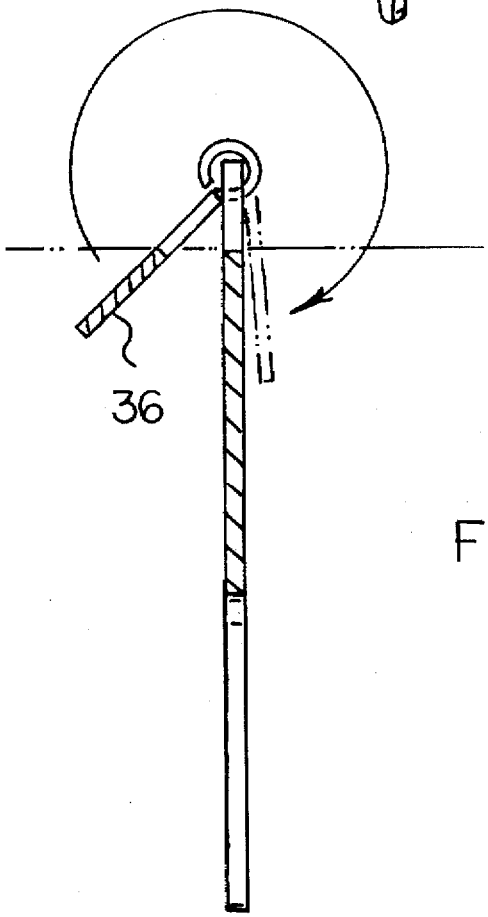
FIG. 14 is a cross-sectional view taken along line 14—14 shown in FIG. 13.

As shown in FIGS. 13–14, an alternate embodiment 30 of the present invention is shown. Such embodiment differs from the preferred embodiment in that it includes a top extent having a top edge with a semicircular cut out 32 formed therein. Preferably, the cut out has a depth of approximately 13/32 of an inch and a diameter of approximately 1 inch. A pair of apertures 34 are formed in diametrically opposite sides of the cut out 7/32 of an inch from the top edge. Further, the cigar support of the prior embodiment is replaced with a U-shaped member 36 with an inner periphery and an outer periphery. The inner periphery has a diameter of approximately one inch while the outer periphery has a diameter of approximately 1 and ¾ inches which is equal to the width of the top extent of the present embodiment. Such cigar support is pivotally coupled at opposite ends thereof to the apertures of the top extent. The pivotal coupling is afforded in a manner similar to that utilized in the preferred embodiment with the exception of the design of the exact loop and apertures which allow the proper positioning of the U-shaped member.

As such, the U-shaped member is adapted to pivot between a first orientation and a second orientation. The first orientation is defined by the U-shaped member depending 45 degrees with respect to a horizontal. In this orientation, the U-shaped member is adapted for allowing the cigar to be supported by a periphery of the cut out and the inner periphery of the U-shaped member. With attention to FIG. 14, the apertures and strips of the U-shaped member are sized and molded to ensure that the strips of the present embodiment are angled properly. The second orientation is constituted by the U-shaped member residing in a vertical orientation in abutment with the ball mark repair tool. In such an orientation, the outer periphery of the U-shaped member is coincident with a periphery of the top extent of the ball mark tool.

In yet another alternate embodiment shown in FIG. 7–12, the ball mark repair tool includes a top extent having a top edge with a generally rectangular cut out similar to the preferred embodiment but with a width of approximately 29/32 of an inch. Also different is a pair of pyramid shaped indents 40 formed on opposite side edges of the cut out approximately ⅜ of an inch above a lower edge of the cut out. For coupling with the indents of the top extent, the cigar support has a generally rectangular configuration with a pair of pyramid shaped detents 42 formed on midpoints of opposite side faces thereof. Preferably, the cigar support has a length of approximately 2 inches and a width of approximately ⅞ of an inch. In addition, an extension 44 is formed on a central portion of the cigar support which protrudes a distance twice the width of the cigar support for ¾ of an inch along the length thereof.

By this structure, the present cigar support is adapted to pivot between a first orientation with the cigar support residing in a horizontal orientation for allowing the cigar to be supported thereon, a second orientation with the cigar support residing in a vertical orientation in abutment with a first side of the ball mark repair tool, and a third orientation with the cigar support residing in a vertical orientation in abutment with a second side of the ball mark repair tool. In the second and third embodiment, the extension of the cigar support resides within the plane in which the cut out resides. It should be noted that the pyramid is orientated such that opposite tongs defined by the cut out of the top extent are biased outwardly when the cigar support resides between the first orientation and the second orientation and between the first orientation and the third orientation. Also, opposite ends of the cigar support and top edges of the tongs are arcuate, whereby they form a circular periphery when the cigar support resides in the second orientation and third orientation thereof.

For precluding lateral movement of the cigar, the cigar support of the present embodiment has a dipped upper surface 48. Alternatively, the cigar support means may have a pair of rails 50 formed along a length of an upper surface for precluding lateral movement of the cigar.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf tool comprising: ball mark repair means for repairing ball marks in a turf, the ball mark repair means having pair of arms for being planted in a turf;

cigar support means coupled to the ball mark repair means for supporting a cigar such that neither end of the cigar is in contact with the turf, the cigar support means coupled to the ball mark repair means and adapted to pivot between a first orientation for allowing a cigar to be rested thereon and a second orientation with the cigar support means residing in a second vertical orientation generally in a plane in which the arm resides, wherein the cigar support means resides in a plane offset from a plane in which the ball mark repair means defines when in the first orientation thereof.

2. A golf tool as set forth in claim 1 wherein the cigar support means has a V-shaped cross-section.

3. A golf tool as set forth in claim 1 wherein the ball mark repair means includes a lower forked extent formed of a pair of downwardly extending elongated arms.

4. A golf tool as set forth in claim 1 wherein the ball mark repair means includes a top extent having a top edge with a generally rectangular cut out formed therein and a pair of apertures formed in the top extent adjacent opposite lower corners of the cut out.

5. A golf tool as set forth in claim 4 wherein the cigar support means further has a generally rectangular configuration and a V-shaped cross-section, the cigar support means pivotally coupled at an end thereof to the apertures of the top extent.

6. A golf tool as set forth in claim 1 wherein the ball mark repair means includes a top extent having a top edge with a semicircular cut out formed therein and a pair of apertures formed in diametrically opposite sides of the cut out adjacent the top edge.

7. A golf tool as set forth in claim 6 wherein the cigar support means is comprised of a U-shaped member with an inner periphery and an outer periphery, the cigar support means pivotally coupled at opposite ends thereof to the apertures of the top extent.

8. A golf tool as set forth in claim 7 wherein the cigar support means is adapted to pivot between a first orientation with the U-shaped member depending 45 degrees with respect to a horizontal for allowing the cigar to be supported by a periphery of the cut out and the inner periphery of the U-shaped member and a second orientation with the U-shaped member residing in a vertical orientation in abutment with the ball mark repair means.

9. A golf tool as set forth in claim 2 wherein the ball mark repair means includes a top extent having a top edge with a generally rectangular cut out formed therein and a pair of pyramid shaped indents formed on opposite side edges of the cut out.

10. A golf tool as set forth in claim 9 wherein the cigar support means has a generally rectangular configuration with a pair of pyramid shaped detents formed on midpoints of opposite side faces thereof for coupling with the indents of the top extent.

11. A golf tool as set forth in claim 10 wherein the cigar support means is adapted to pivot between a first orientation with the cigar support means residing in a horizontal orientation for allowing the cigar to be supported thereon, a second orientation with the cigar support means residing in a vertical orientation in abutment with a first side of the ball mark repair means, and a third orientation with the cigar support means residing in a vertical orientation in abutment with a second side of the ball mark repair means, whereby the pyramid is orientated such that opposite tongs defined by the cut out of the top extent are biased outwardly when the cigar support means resides between the first orientation and the second orientation and between the first orientation and the third orientation.

12. A golf tool as set forth in claim 11 wherein the cigar support means has a dipped upper surface for precluding lateral movement of the cigar.

13. A golf tool as set forth in claim 11 wherein the cigar support means has a pair of rails formed along a length of an upper surface for precluding lateral movement of the cigar.

14. A golf tool comprising:

ball mark repair means for repairing ball marks in a turf, the ball mark repair means having a pair of arms for being planted in a turf; and cigar support means coupled to the ball mark repair means for supporting a cigar such that neither end of the cigar is in contact with the turf, the cigar support means coupled to the ball mark repair means and adapted to pivot between a first orientation for allowing a cigar to be supported thereon and a second orientation with the cigar support means residing in a second vertical orientation generally in a plane in which the arm resides, wherein the cigar support means resides in a plane offset from a plane in which the ball mark repair means defines when in the first orientation thereof;

said ball mark repair means including a top extent having a top edge with a semicircular cut out formed therein with a depth of 13/32 of an inch and a pair of apertures formed in diametrically opposite sides of the cut out 2/32 of an inch from the top edge;

said cigar support means comprised of a U-shaped member with an inner periphery and an outer periphery, the cigar support means pivotally coupled at opposite ends thereof to the apertures of the top extent of the ball mark repair means via a pair of strips integrally coupled thereto, the inner periphery having a diameter of approximately 1 inch;

said cigar support means adapted to pivot between a first orientation with the U-shaped member depending about 45 degrees with respect to a horizontal for allowing the cigar to be supported by a periphery of the cut out and the inner periphery of the U-shaped member and a second orientation with the U-shaped member residing in a vertical orientation in abutment with the ball mark repair means.

* * * * *